US011309631B2

(12) United States Patent
Iino

(10) Patent No.: US 11,309,631 B2
(45) Date of Patent: Apr. 19, 2022

(54) STACKED PATCH ANTENNA

(71) Applicant: HARADA INDUSTRY CO., LTD., Tokyo (JP)

(72) Inventor: Shinji Iino, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 23 days.

(21) Appl. No.: 16/917,675

(22) Filed: Jun. 30, 2020

(65) Prior Publication Data

US 2021/0036426 A1 Feb. 4, 2021

(30) Foreign Application Priority Data

Aug. 2, 2019 (JP) ..... JP2019-143359

(51) Int. Cl.
*H01Q 1/24* (2006.01)
*H01Q 9/04* (2006.01)

(52) U.S. Cl.
CPC ..... *H01Q 9/0414* (2013.01)

(58) Field of Classification Search
CPC ..... H01Q 9/0414
USPC ..... 343/700 MS
See application file for complete search history.

(56) References Cited

U.S. PATENT DOCUMENTS 7,046,203 B2 * 5/2006 Yuanzhu ..... H01Q 1/243 343/700 MS
8,154,467 B2 * 4/2012 Mitsui ..... H01Q 21/28 343/833
10,741,906 B2 * 8/2020 Gomez Angulo ..... H01Q 1/243

FOREIGN PATENT DOCUMENTS

JP 2003-309424 A 10/2003
JP 2010-226633 A 10/2010

* cited by examiner

*Primary Examiner* — Peguy Jean Pierre
(74) *Attorney, Agent, or Firm* — Global IP Counselors, LLP

(57) ABSTRACT

A stacked patch antenna includes a circuit board, a first patch antenna, a second patch antenna, and a parasitic element. The first patch antenna is stacked on the circuit board, has a first power feeding line and a first radiation element, and receives signals in a first frequency band. The second patch antenna is stacked on the first patch antenna 20 has a second power feeding line longer than the first power feeding line and penetrating the first radiation element to be connected to a second power feeding portion and a second radiation element smaller in size than the first radiation element, and receives signals in a second frequency band higher than the first frequency band. The parasitic element is a plate-like element disposed above the second patch antenna so as to improve elevation angle reception characteristics of the second patch antenna.

16 Claims, 2 Drawing Sheets

STACKED PATCH ANTENNA

BACKGROUND

Technical Field

The present invention generally relates to a stacked patch antenna, and more particularly to a stacked patch antenna having a stack structure using a plurality of patch antennas.

Description of the Related Art

There are nowadays various types of antennas mounted on a vehicle. For example, antennas required to realize various communication services, such as radio, television, mobile phone, GNSS (Global Navigation Satellite System), SDARS (Satellite Digital Audio Radio Service) are mounted. These antennas are accommodated in, for example, a low-profile antenna device installed on a vehicle roof.

A patch antenna using a ceramic, a dielectric substrate, or the like is known as an antenna for receiving circularly polarized signals of these vehicle-mounted antenna devices. As the patch antenna, there is known a stacked patch antenna having a plurality of stacked patch antennas. The stacked patch antenna has the following antenna reception sensitivity characteristics. That is, when an upper-layer patch antenna is configured to receive signals in a lower frequency band as compared to a lower-layer patch antenna, the upper-layer patch antenna has a comparatively good sensitivity with respect to signals transmitted from near the top (i.e., 90° position from the horizontal) but has a poor sensitivity with respect to signals transmitted from low elevation angles (e.g., about 30° position from the horizontal).

On the other hand, there is also a known stacked patch antenna configured such that an upper-layer patch antenna is configured to receive signals in a higher frequency band as compared to a lower-layer patch antenna (for example, Patent Document 1 and Patent Document 2).

CITATION LIST

Patent Document

Patent Document 1: Japanese Patent Application Kokai Publication No. 2003-309424

Patent Document 2: Japanese Patent Application Kokai Publication No. 2010-226633

In terms of elevation angles, antennas for GNSS and SDARS are required to have a good reception sensitivity not only with respect to signals from the top, but also with respect to signals from low elevation angles. In a stacked patch antenna like those in Patent Document 1 and Patent Document 2 in which an upper-layer patch antenna is configured to receive signals in a higher frequency band as compared to a lower-layer patch antenna, the reception sensitivity characteristics of the upper-layer patch antenna at low elevation angles are not poor, but the reception sensitivity characteristics at around middle to high elevation angles (e.g., about 30° to) 90° are poor. This is because a power feeding line of the upper-layer patch antenna configured to receive signals in a higher frequency band extends longer than a power feeding line of the lower-layer patch antenna, so that the long power feeding line exerts adverse effects on the antenna reception sensitivity characteristics. Thus, the adverse effects on the antenna reception sensitivity characteristics due to the longer power feeding line of the patch antenna for high frequency band are more serious than those brought about by the patch antenna for a lower frequency band.

Thus, a stacked patch antenna, in which the upper-layer patch antenna is configured to receive signals in a higher frequency band as compared to the lower-layer patch antenna, is demanded to have improved antenna reception sensitivity characteristics not only at low elevation angles, but also at middle to high elevation angles.

SUMMARY

In view of the above situation, the present disclosure has been made and the object thereof is to provide a stacked patch antenna capable of having improved reception sensitivity characteristics also at middle to high elevation angles.

In order to achieve the above object of the present disclosure, a stacked patch antenna can comprise: a circuit board having a first power feeding portion and a second power feeding portion; a first patch antenna stacked on the circuit board, having a first power feeding line connected to the first power feeding portion and a first radiation element, and configured to receive signals in a first frequency band; a second patch antenna stacked on the first patch antenna, having a second power feeding line longer than the first power feeding line and penetrating the first radiation element to be connected to the second power feeding portion and a second radiation element smaller in size than the first radiation element, and configured to receive signals in a second frequency band higher than the first frequency band; and a plate-like parasitic element disposed above the second patch antenna so as to improve elevation angle reception characteristics of the second patch antenna.

The first patch antenna may be a plate-like air patch antenna in which the first radiation element is formed of a plate-like element, and the circuit board may have a ground conductor pattern.

The first radiation element may include a quadrangular plate-like element disposed opposite to the circuit board with a predetermined interval from the circuit board and a plurality of leg portions for supporting the plate-like element.

At least one of the leg portions may be the first power feeding line of the plate-like air patch antenna.

The first power feeding line of the first patch antenna may be formed by cutting and bending a part of a radiation surface of the plate-like element.

The second power feeding line of the second patch antenna may penetrate a slit formed by the cutting and bending for forming the first power feeding line.

The stacked patch antenna may further include an integrated resin holder for supporting the circuit board, the first patch antenna, and the parasitic element, and the second patch antenna may be fixed to the first radiation element.

The integrated resin holder may have a plate support portion disposed between a plate-like air patch antenna and the circuit board to support the plate-like air patch antenna, a circuit board locking pawl extending from the plate support portion toward the circuit board to hold the circuit board, and a parasitic element locking pawl extending from the plate support portion toward the parasitic element to hold the parasitic element.

The second patch antenna may use, as a dielectric body, one of a ceramic, a synthetic resin, and a multilayer substrate.

The parasitic element may have a hexagonal body having two opposing parallel sides, a lower side perpendicular to the two left and right sides, and upper side shorter than the lower side and parallel to the lower side, and in a plan view, a length from the upper side to lower side of the parasitic element may be larger than a length from the upper side to lower side of the second patch antenna, and the width from the left side and right side of the parasitic element may be smaller than the width of the second patch antenna.

The stacked patch antenna may further include an insulating spacer disposed between the second patch antenna and the parasitic element to support the parasitic element.

The stacked patch antenna according to the present disclosure has an advantage in that reception sensitivity characteristics at also middle to high elevation angles can be improved.

PREFERRED EMBODIMENTS

Figure 1:
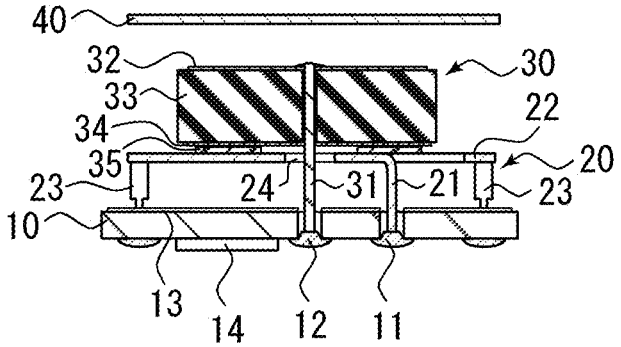
FIG. 1 is a schematic cross-sectional side view for explaining a stacked patch antenna according to one illustrated embodiment.

Preferred embodiments will be described below with reference to the accompanying drawings. FIG. 1 is a schematic cross-sectional side view for explaining a stacked patch antenna according to one illustrated embodiment. A stacked patch antenna according to the present invention has a stack structure using a plurality of patch antennas. As illustrated, the stacked patch antenna mainly includes a circuit board 10, a first patch antenna 20, a second patch antenna 30, and a parasitic element 40. For example, the above components are configured as one module and accommodated in a vehicle-mounted antenna device together with other antennas such as an AM/FM antenna and a mobile phone antenna.

The circuit board 10 includes a first power feeding portion 11 and a second power feeding portion 12. A circuit pattern and a ground conductor pattern 13 are formed on the circuit board 10 by etching or the like. For example, an amplifier circuit 14 or the like may further be placed on the circuit board 10.

The first patch antenna 20 receives signals in a first frequency band. The first frequency band may be a frequency band for, for example, GNSS, which ranges from 1 GHz to 2 GHz; however, the frequency band supported by the first patch antenna 20 of the stacked patch antenna according to the present invention is not limited to the above frequency band and may be another frequency band. The first patch antenna 20 is stacked on the circuit board 10. The first patch antenna 20 includes a first power feeding line 21 and a first radiation element 22. The first power feeding line 21 is connected to the first power feeding portion 11 of the circuit board 10. In the illustrated example, the first patch antenna 20 is a plate-like air patch antenna in which the first radiation element 22 is formed of a plate-like element; however, the first patch antenna 20 of the stacked patch antenna according to the present invention is not limited to this, but may use a ceramic, a synthetic resin, a multilayer substrate or the like as a dielectric body.

Figure 2:
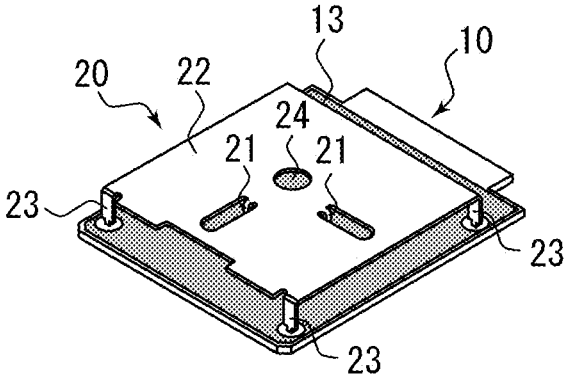
FIG. 2 is a schematic perspective view for explaining a first patch antenna of the stacked patch antenna according to the illustrated embodiment.

The first patch antenna 20 will be described in more detail using FIG. 2. FIG. 2 is a schematic perspective view for explaining the first patch antenna of the stacked patch antenna according to the illustrated embodiment. In FIG. 2, the same reference numerals as those in FIG. 1 denote the same parts as those in FIG. 1. The first patch antenna 20 of the illustrated embodiment is a plate-like air patch antenna. The circuit board 10 has, for example, a ground conductor pattern 13. The ground conductor pattern 13 constitutes a micro-strip antenna together with the first radiation element 22. The first radiation element 22 is a quadrangular plate-like element and is disposed opposite to the circuit board 10 with a predetermined interval therefrom. The plate-like element is supported by a plurality of leg portions 23. The plurality of leg portions 23 may be formed such that when, for example, the first radiation element 22 is cut from a metal plate and subjected to sheet metal processing, parts projecting from four corners of the quadrangular plate-like element are bent. In the plate-like element having the leg portions 23 formed by bending protrusions extending from the four corners as in the illustrated embodiment, the electric length of the element is increased due to the presence of the leg portions 23. That is, in the drawing, the leg portions 23 extend from each of the top and bottom edges of the plate-like element, so that the electric length in the top/bottom direction is seen to be longer than that in the left/right direction. Thus, in this example, the plate-like element is not square, but rectangular with a length shorter in the top/bottom direction than that in the left/right direction. The leg portions 23 may not necessarily be formed by bending the plate-like element, but may be constituted by bar-like members separated from the plate-like element. The leg portions 23 may be fixed to the circuit board 10 by soldering or other means. In this case, the leg portions 23 are connected to the ground conductor pattern 13 through, for example, a capacitor. This is for compensating for insufficient capacity of the plate-like element. Alternatively, the capacity of the plate-like element may be compensated for by, for example, a meander-like wiring pattern. When the capacity is sufficient, the leg portions 23 may be fixed in a state being insulated from the ground conductor pattern 13 or the like. When the plate-like element can be supported by a means other than the leg portions 23, the leg portions 23 may be eliminated. Further, one of the leg portions 23 may be used as the first power feeding line 21. In the first patch antenna 20 of the illustrated example, the first power feeding line 21 is formed by bending a part of the radiation surface of the quadrangular plate-like element. Further, the first patch antenna 20 of the illustrated example is a dual feed patch antenna, and thus, two first power feeding lines 21 are formed; however, the present invention is not limited to this, but the first patch antenna 20 may be a single feed patch antenna. Alternatively, the power feeding line may be constituted by a separated bar-like member. The plate-like element has a through hole 24 through which a second power feeding line 31 of the second patch antenna 30 to be described later passes; however, the present invention is not limited to this, but the second power feeding line 31 may be made to pass through a slit formed by cutting and bending a part of the radiation surface during the formation process of the first power feeding line 21.

Referring back to FIG. 1, the second patch antenna 30 will be described. The second patch antenna 30 receives signals in a second frequency band higher than the above first frequency band. The second frequency band may be a frequency band for, for example, SDARS, which is 2.3 GHz; however, the frequency band supported by the second patch antenna 30 of the stacked patch antenna according to the present invention is not limited to the above frequency band and may be another frequency band higher than the first frequency band. The second patch antenna 30 is stacked on the first patch antenna 20. The second patch antenna 30 includes a second power feeding line 31 and a second radiation element 32. The second power feeding line 31 is connected to the second power feeding portion 12 of the circuit board 10. That is, the second power feeding line 31 is longer than the first power feeding line 21 and is connected to the second power feeding portion 12 of the circuit board 10 through the first radiation element 22. The second power feeding line 31 may be connected to the second power feeding portion 12 by passing through the through hole 24 formed in the first radiation element 22 of the first patch antenna 20. The second radiation element 32 is smaller in size than the first radiation element 22. In the example illustrated in FIG. 1, the second patch antenna 30 is a ceramic patch antenna using a ceramic 33 as a dielectric body; however, the second patch antenna 30 of the stacked patch antenna according to the present invention is not limited to this, but may use a synthetic resin, a multilayer substrate or the like as a dielectric body. In the illustrated example, a ground conductor pattern 34 formed on the back surface of the ceramic 33 constitutes a micro-strip antenna together with the second radiation element 32. Further, the second patch antenna 30 may be fixed onto the first patch antenna 20 with, for example, a double-sided adhesive tape 35. This allows the first radiation element 22 of the first patch antenna 20 and the ground conductor pattern 34 to be electrically insulated from each other.

The second patch antenna 30 provided on the first patch antenna 20 receives signals in a higher frequency band. When the longer second power feeding line 31 is used, antenna reception sensitivity characteristics of the second patch antenna 30 at middle to high elevation angles can be affected, as described in the Description of the Related Art. Thus, in the stacked patch antenna according to the present disclosure, the following structure is adopted so as to improve the reception sensitivity characteristics.

That is, as illustrated in FIG. 1, in the stacked patch antenna according to the illustrated embodiment, the parasitic element 40 is used so as to improve the elevation angle reception characteristics of the second patch antenna 30. The parasitic element 40 is a plate-like element. The parasitic element 40 may be, for example, a conductive plate. The parasitic element 40 is disposed above the second patch antenna 30.

Figure 3:
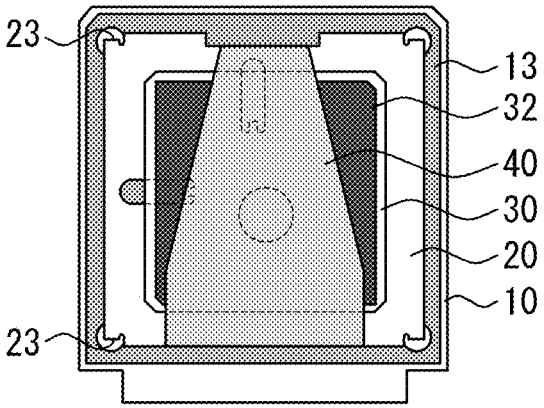
FIG. 3 is a schematic top view for explaining a parasitic element of the stacked patch antenna according to the illustrated embodiment.

The parasitic element 40 will be described in more detail using FIG. 3. FIG. 3 is a schematic top view for explaining the parasitic element of the stacked patch antenna according to the illustrated embodiment. In FIG. 3, the same reference numerals as those in FIG. 1 denote the same parts as those in FIG. 1. When the stacked patch antenna according to the present disclosure is applied to, for example, a so-called shark-fin shaped low-profile antenna device, the upward direction in FIG. 3 corresponds to a vehicle travel direction and the tip side of the shark-fin antenna. The parasitic element 40 of the stacked patch antenna according to the present disclosure may have a hexagonal plate-like body like the one illustrated in FIG. 3. Specifically, the parasitic element 40 may have a hexagonal body having two opposing parallel left and right sides, a lower side perpendicular to the two sides, and an upper side shorter than the lower side and parallel to the lower side. Further, in a plan view, the length from the upper side to lower side of the parasitic element 40 may be larger than the length from the upper side to lower side of the second patch antenna 30, and the width from the left side and right side of the parasitic element 40 may be smaller than the width of the second patch antenna 30. In other words, the length of the lower side of the hexagon may be smaller than the width of the second patch antenna 30, and the length from the upper side to lower side of the hexagon may be larger than the length from the upper side to lower side of the second patch antenna 30. More specifically, the length from the upper side to lower side of the parasitic element 40 may be larger than the length from the upper side to lower side of the second radiation element 32 of the second patch antenna 30, and the width from the left side and right side of the parasitic element 40 may be smaller than the width of the second radiation element 32 of the second patch antenna 30. In the stacked patch antenna according to the present disclosure, the shape of the parasitic element 40 is not limited to a hexagon and may be, for example, a trapezoid. Specifically, the trapezoid may be a quadrangle having the upper side shorter than the lower side and parallel to the lower side. Further, the length of the upper side of the trapezoid may be smaller than the width of the second patch antenna 30, and the length from the upper side to lower side of the trapezoid may be larger than the length from the upper side to lower side of the second patch antenna 30. In the illustrated example, the length from the upper side to lower side of the parasitic element 40 is equivalent to the length from the upper side to lower side of the first patch antenna 20.

Figure 4:
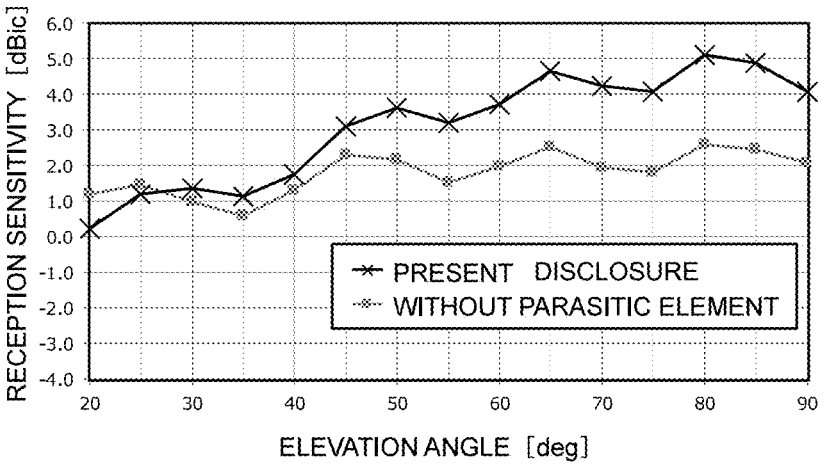
FIG. 4 is a graph of reception sensitivity characteristics of the stacked patch antenna according to the illustrated embodiment with respect to elevation angles.

FIG. 4 is a graph of the reception sensitivity characteristics of the stacked patch antenna according to the present disclosure with respect to elevation angles. In the graph, the black line represents the characteristics of the second patch antenna of the stacked patch antenna according to the present disclosure, and the gray line represents the characteristics of a patch antenna in the upper layer in a configuration not using the parasitic element. The graph reveals that an average gain is significantly improved at middle to high elevation angles, particularly, in the range of 30° or more. Thus, in the stacked patch antenna according to the present disclosure, the reception sensitivity characteristics of the second patch antenna in the upper layer at middle to high elevation angles are improved by adopting the above-mentioned stack structure.

The following describes a method of installing the parasitic element 40 above the second patch antenna 30. For example, an insulating spacer is provided between the second patch antenna 30 and the parasitic element 40 so as to support the parasitic element 40 above the second patch antenna 30. The insulating spacer may be a double-sided adhesive tape having a certain thickness. When the stacked patch antenna according to the present disclosure is applied to a low-profile antenna device, the parasitic element 40 is provided on the side of an antenna cover side of the low-profile antenna device, and the antenna cover is placed over a base plate so as to dispose the parasitic element 40 above the second patch antenna 30.

When the parasitic element is disposed on the antenna cover side as described above, the distance or relative position between the parasitic element and the second patch antenna may fail to be constant due to displacement between the antenna cover and the base plate or assembly error therebetween, etc. The following describes an example in which a holder is used to make the distance between the parasitic element and the second patch antenna constant.

Figure 5:
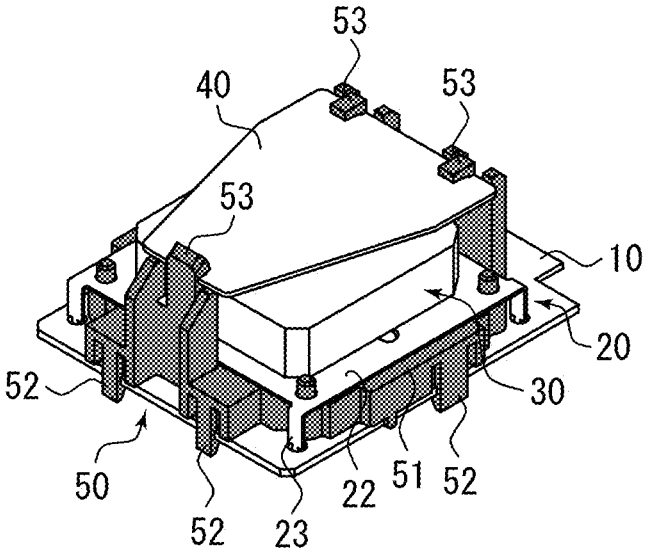
FIG. 5 is a schematic perspective view for explaining an example in which the stacked patch antenna according to the present disclosure is modularized using an integrated resin holder.

FIG. 5 is a schematic perspective view for explaining an example in which the stacked patch antenna according to the present disclosure is modularized using an integrated resin holder. In FIG. 5, the same reference numerals as those in FIG. 1 denote the same parts as those in FIG. 1. The illustrated stacked patch antenna according to the present disclosure has an integrated resin holder 50. The integrated resin holder 50 supports the circuit board 10, the first patch antenna 20, and the parasitic element 40. The integrated resin holder 50 is made of an insulating resin. The second patch antenna 30 is fixed to the first radiation element 22. The integrated resin holder 50 supports the circuit board 10 as well as the first patch antenna 20 stacked on the circuit board 10. Specifically, when the first patch antenna 20 is a plate-like air patch antenna, the integrated resin holder 50 preferably supports the first radiation element 22 of the plate-like air patch antenna. This is because the second patch antenna 30 is stacked on the first patch antenna 20. That is, the second patch antenna 30 is stacked on the first radiation element 22 of the first patch antenna 20, so that the first radiation element 22 or the leg portions 23 may bend due to the weight of the second patch antenna 30. Thus, the first patch antenna 20 which is a plate-like air patch antenna is supported by a plate support portion 51 of the integrated resin holder 50. Specifically, the plate support portion 51 is disposed between the first radiation element 22 of the plate-like air patch antenna and the circuit board 10, and the entire body of the first radiation element 22 of the plate-like air patch antenna is supported by the plate support portion 51. A through hole or the like through which the second power feeding line passes may be appropriately formed in the plate support portion 51. The integrated resin holder 50 has the plate support portion 51 as a main component and further has circuit board locking pawls 52 and the parasitic element locking pawls 53. The circuit board locking pawls 52 extend from the plate support portion 51 toward the circuit board 10 to hold the circuit board 10. The circuit board locking pawls 52 may be provided so as to hold and lock, for example, at least two sides of the rectangular circuit board 10. Alternatively, the circuit board locking pawls 52 may be provided so as to hold and lock three or four sides of the circuit board 10. Concave portions may be appropriately formed in the circuit board 10 at positions corresponding to the circuit board locking pawls 52. The parasitic element locking pawls 53 extend from the plate support portion 51 toward the parasitic element 40 to hold the parasitic element 40. The parasitic element locking pawls 53 may be provided so as to hold and lock, for example, the upper and lower sides of the hexagonal parasitic element 40 illustrated in FIG. 3. Concave portions may be appropriately formed in the parasitic element 40 at positions corresponding to the parasitic element locking pawls 53. The parasitic element locking pawls 53 may be provided so as to hold and rock the front and back sides of the parasitic element 40 to make the height position of the parasitic element 40 constant.

As described above, the distance and relative position between the parasitic element 40 and the second patch antenna 30 are made always constant by modularizing the stacked patch antenna according to the present disclosure using the integrated resin holder, which makes antenna performance stable and improves assemblability during manufacturing.

The stacked patch antenna according to the present invention is not limited to the above illustrative examples but may be variously modified without departing from the scope of the present invention.

What is claimed is:

1. A stacked patch antenna having a stacked structure using a plurality of patch antennas, the stacked patch antenna comprising:

a circuit board having a first power feeding portion and a second power feeding portion;

a first patch antenna stacked on the circuit board, having a first power feeding line connected to the first power feeding portion and a first radiation element, and configured to receive signals in a first frequency band;

a second patch antenna stacked on the first patch antenna, having a second power feeding line longer than the first power feeding line and penetrating the first radiation element to be connected to the second power feeding portion and a second radiation element smaller in size than the first radiation element, and configured to receive signals in a second frequency band higher than the first frequency band; and a plate-like parasitic element disposed above the second patch antenna so as to improve elevation angle reception characteristics of the second patch antenna.

2. The stacked patch antenna according to claim 1, wherein the first patch antenna is a plate-like air patch antenna in which the first radiation element is formed of a plate-like element, and the circuit board has a ground conductor pattern.

3. The stacked patch antenna according to claim 2, wherein the first radiation element includes a quadrangular plate-like element disposed opposite to the circuit board with a predetermined interval from the circuit board and a plurality of leg portions for supporting the plate-like element.

4. The stacked patch antenna according to claim 3, wherein at least one of the leg portions is the first power feeding line of the plate-like air patch antenna.

5. The stacked patch antenna according to claim 3, wherein the first power feeding line of the first patch antenna is formed by cutting and bending a part of a radiation surface of the plate-like element.

6. The stacked patch antenna according to claim 5, wherein the second power feeding line of the second patch antenna penetrates a slit formed by the cutting and bending for forming the first power feeding line.

7. The stacked patch antenna according to claim 2, further comprising an integrated resin holder for supporting the circuit board, the first patch antenna, and the parasitic element, wherein the second patch antenna is fixed to the first radiation element.

8. The stacked patch antenna according to claim 7, wherein the integrated resin holder has a plate support portion disposed between a plate-like air patch antenna and the circuit board to support the plate-like air patch antenna, a circuit board locking pawl extending from the plate support portion toward the circuit board to hold the circuit board, and a parasitic element locking pawl extending from the plate support portion toward the parasitic element to hold the parasitic element.

9. The stacked patch antenna according to claim 8, wherein the second patch antenna uses, as a dielectric body, one of a ceramic, a synthetic resin, and a multilayer substrate.

10. The stacked patch antenna according to claim 8, wherein the parasitic element has a hexagonal body having two opposing parallel sides, a lower side perpendicular to the two left and right sides, and an upper side shorter than the lower side and parallel to the lower side, and in a plan view, a length from the upper side to lower side of the parasitic element is larger than a length from the upper side to lower side of the second patch antenna, and the width from the left side and right side of the parasitic element is smaller than the width of the second patch antenna.

11. The stacked patch antenna according to claim 7, wherein the second patch antenna uses, as a dielectric body, one of a ceramic, a synthetic resin, and a multilayer substrate.

12. The stacked patch antenna according to claim 7, wherein the parasitic element has a hexagonal body having two opposing parallel sides, a lower side perpendicular to the two left and right sides, and an upper side shorter than the lower side and parallel to the lower side, and in a plan view, a length from the upper side to lower side of the parasitic element is larger than a length from the upper side to lower side of the second patch antenna, and the width from the left side and right side of the parasitic element is smaller than the width of the second patch antenna.

13. The stacked patch antenna according to claim 1, wherein the second patch antenna uses, as a dielectric body, one of a ceramic, a synthetic resin, and a multilayer substrate.

14. The stacked patch antenna according to claim 13, wherein the parasitic element has a hexagonal body having two opposing parallel sides, a lower side perpendicular to the two left and right sides, and an upper side shorter than the lower side and parallel to the lower side, and in a plan view, a length from the upper side to lower side of the parasitic element is larger than a length from the upper side to lower side of the second patch antenna, and the width from the left side and right side of the parasitic element is smaller than the width of the second patch antenna.

15. The stacked patch antenna according to claim 1, wherein the parasitic element has a hexagonal body having two opposing parallel sides, a lower side perpendicular to the two left and right sides, and an upper side shorter than the lower side and parallel to the lower side, and in a plan view, a length from the upper side to lower side of the parasitic element is larger than a length from the upper side to lower side of the second patch antenna, and the width from the left side and right side of the parasitic element is smaller than the width of the second patch antenna.

16. The stacked patch antenna according to claim 1, further comprising an insulating spacer disposed between the second patch antenna and the parasitic element to support the parasitic element.

* * * * *